US009581159B2

(12) United States Patent
Sugihara et al.

(10) Patent No.: US 9,581,159 B2
(45) Date of Patent: Feb. 28, 2017

(54) ELECTRIC OIL PUMP

(71) Applicant: KAYABA INDUSTRY CO., LTD., Minato-ku, Tokyo (JP)

(72) Inventors: Masamichi Sugihara, Kani (JP); Tomoyuki Fujita, Kani (JP); Koichiro Akatsuka, Gifu (JP)

(73) Assignee: KYB Corporation, Tokyo (JP)

( * ) Notice: Subject to any disclaimer, the term of this patent is extended or adjusted under 35 U.S.C. 154(b) by 287 days.

(21) Appl. No.: 14/238,157

(22) PCT Filed: Nov. 28, 2012

(86) PCT No.: PCT/JP2012/080785
§ 371 (c)(1),
(2) Date: Feb. 10, 2014

(87) PCT Pub. No.: WO2013/099505
PCT Pub. Date: Jul. 4, 2013

(65) Prior Publication Data

US 2014/0169995 A1 Jun. 19, 2014

(30) Foreign Application Priority Data

Dec. 28, 2011 (JP) ..... 2011-287893

(51) Int. Cl.
*F04B 17/03* (2006.01)
*F04C 15/06* (2006.01)
(Continued)

(52) U.S. Cl.
CPC ..... *F04C 15/06* (2013.01); *F04B 17/03* (2013.01); *F04B 53/18* (2013.01); *F04C 15/008* (2013.01);
(Continued)

(58) Field of Classification Search
CPC .... F04C 15/06; F04C 15/0046; F04C 15/008; F04C 2/10; F04C 2210/206; F04C 2240/45; F04B 17/03; F04B 53/18
(Continued)

(56) References Cited

U.S. PATENT DOCUMENTS 3,102,487 A * 9/1963 Griswold ..... F04B 1/07 417/364
3,103,890 A * 9/1963 Griswold ..... F04B 1/07 417/364
(Continued)

FOREIGN PATENT DOCUMENTS

CN 1534195 A 10/2004
CN 1918406 A 2/2007
(Continued)

OTHER PUBLICATIONS

International Search Report mailed Feb. 19, 2013, in corresponding International Application No. PCT/JP2012/080785.
(Continued)

*Primary Examiner* — Patrick Hamo
(74) *Attorney, Agent, or Firm* — Hauptman Ham, LLP

(57) ABSTRACT

An electric oil pump includes an electric motor and an oil pump that is driven by the motive power from an electric motor, wherein; the oil pump has an introducing channel that guides a drain oil that has leaked from an interior of the oil pump to an interior of the electric motor; and the electric motor has a discharging channel that discharges the drain oil that has been guided to the interior of the electric motor to a tank.

7 Claims, 1 Drawing Sheet

(51) Int. Cl.
*F04B 53/18* (2006.01)
*F04C 15/00* (2006.01)
*F04C 2/10* (2006.01)

(52) U.S. Cl.
CPC ..... *F04C 15/0046* (2013.01); *F04C 2/10* (2013.01); *F04C 2210/206* (2013.01); *F04C 2240/45* (2013.01)

(58) Field of Classification Search
USPC ..... 417/355, 357, 364, 374, 380, 410.1, 417/410.3, 410.4, 410.5
See application file for complete search history.

(56) References Cited

U.S. PATENT DOCUMENTS 3,161,136 A * 12/1964 Clark ..... F04B 1/07 417/319
3,162,131 A * 12/1964 Clark ..... F04B 1/07 188/151 R
3,165,062 A * 1/1965 Clark ..... F04B 1/07 417/319
4,859,161 A * 8/1989 Teruyama ..... F04C 15/0088 418/102
6,329,731 B1 * 12/2001 Arbanas ..... F16H 57/0416 310/52
7,314,359 B2 * 1/2008 Fujita ..... F04C 2/344 418/133
7,381,036 B2 * 6/2008 Hundt ..... F04C 11/001 417/355
7,837,453 B2 * 11/2010 Barthel ..... F16H 57/0434 418/61.3
2002/0157481 A1 * 10/2002 Kogiso ..... G01L 3/104 73/862.333
2002/0197172 A1 * 12/2002 Loprete ..... F04C 29/005 417/410.5
2003/0035742 A1 * 2/2003 Vukovich ..... F16H 61/0031 417/374
2004/0116227 A1 * 6/2004 Fujioka ..... B60K 6/365 475/5
2004/0179953 A1 * 9/2004 Suzuki ..... F04C 2/086 417/310
2005/0181905 A1 * 8/2005 Ali ..... F02B 67/06 475/210
2006/0088433 A1 * 4/2006 Fujita ..... F04C 2/344 418/140
2007/0175212 A1 * 8/2007 Uno ..... F01C 13/04 60/519
2008/0003124 A1 * 1/2008 Eisenmann ..... F03C 2/22 418/61.3
2008/0206078 A1 * 8/2008 Yamamoto ..... F04C 2/102 417/410.4
2008/0273990 A1 * 11/2008 Pham ..... F04D 17/122 417/53
2009/0010776 A1 * 1/2009 Tsuchiya ..... F04C 28/06 417/410.5
2009/0022608 A1 * 1/2009 Rogner ..... F04C 15/008 417/423.1
2009/0088286 A1 * 4/2009 Fujita ..... F16H 48/08 475/230
2009/0104060 A1 * 4/2009 Sato ..... F04C 18/0215 418/5
2010/0028172 A1 * 2/2010 Heuver ..... F04C 2/10 417/364
2012/0051960 A1 * 3/2012 Nakamura ..... F04C 15/0038 418/104
2012/0076674 A1 * 3/2012 Nomura ..... B60K 6/445 417/319
2012/0076675 A1 * 3/2012 Nomura ..... B60K 6/445 417/319
2015/0059328 A1 * 3/2015 Suzuki ..... E02F 9/202 60/419
2015/0064030 A1 * 3/2015 Suzuki ..... F04B 17/03 417/372

FOREIGN PATENT DOCUMENTS

DE 10000765 A1 * 7/2001 ..... F04B 1/2014
EP 1457678 A1 9/2004
JP 2001-289315 A 10/2001
JP 2002-349453 A 12/2002
JP 2004-278381 A 10/2004
JP WO 2006090483 A1 * 8/2006 ..... F04C 2/086

OTHER PUBLICATIONS

Office Action dated Jun. 18, 2015, corresponding to Chinese patent application No. 201280028596.5.

* cited by examiner

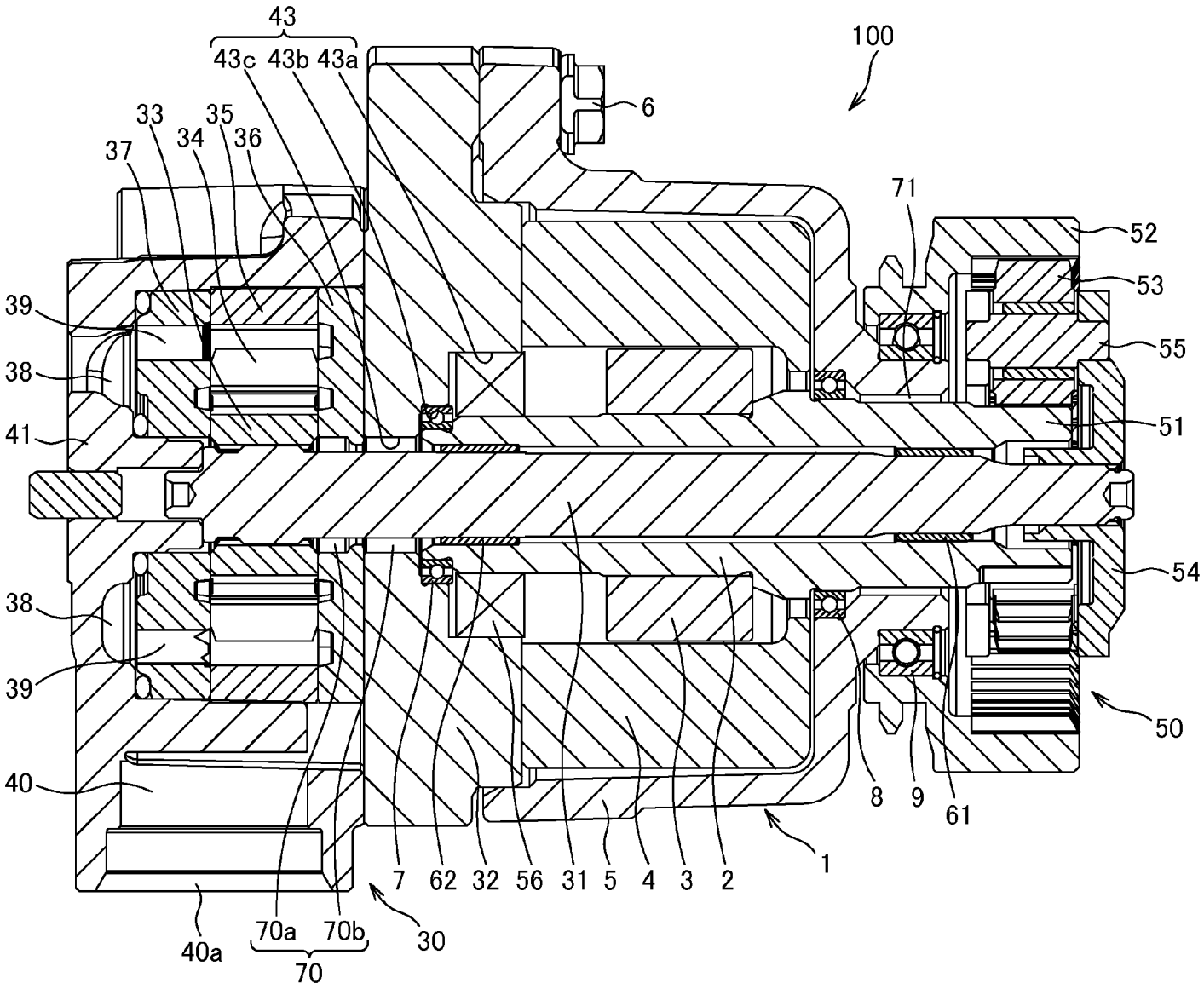
100
6
43
43a
43b
43c
36
35
34
33
37
39
38
41
38
39
40
40a
70
70a
70b
30
7
62
32
56
31
5
4
3
2
1
8
9
61
71
52
53
55
51
54
50

ELECTRIC OIL PUMP

RELATED APPLICATIONS

The present application is a National Phase of International Application Number PCT/JP2012/080785, filed Nov. 28, 2012, which claims priority to Japanese Application Number 2011-287893, filed Dec. 28, 2011.

TECHNICAL FIELD

This invention relates to an electric oil pump.

BACKGROUND ART

An oil pump that is driven by a motive power from an electric motor is disclosed in JP2001-289315A.

SUMMARY OF THE INVENTION

As the electric motors that drive the oil pumps of this type have oilproof structures in order to prevent oil that may contain contaminants from entering the interior of the electric motor. However, in order to achieve the oilproof structures in the electric motors, it is required to provide oil seals and O-rings, causing the cost to increase.

This invention has been designed in consideration of this problem, and an object thereof is to provide a low-cost electric oil pump.

According to one aspect of this invention, an electric oil pump comprising an electric motor and an oil pump that is driven by a motive power from the electric motor is provided. The oil pump has an introducing channel that guides a drain oil that has leaked from an interior of the oil pump to an interior of the electric motor; and the electric motor has a discharging channel that discharges the drain oil that has been guided to the interior of the electric motor to a tank.

Embodiments of the present invention and advantages thereof are described in detail below with reference to the accompanying drawings.

BRIEF DESCRIPTION OF THE DRAWINGS

FIG. 1 is a sectional view of an electric oil pump according to an embodiment of this invention.

EMBODIMENTS OF THE INVENTION

An electric oil pump 100 according to an embodiment of this invention will be described below with reference to the drawing.

The electric oil pump 100 is used as a hydraulic supply source that supplies a working oil (working fluid) to hydraulic equipment, such as, a continuously variable transmission etc. installed in a vehicle.

The electric oil pump 100 includes an electric motor 1 and an oil pump 30 that is driven by the motive power from the electric motor 1 and supplies the working oil to hydraulic equipment. The oil pump 30 is also driven by the motive power from an engine (not shown) on a vehicle, and thus, the oil pump 30 is selectively driven by the motive power from the electric motor 1 or the engine.

The electric motor 1 has an output shaft 2 that outputs the motive power. The output shaft 2 is formed to have a hollow cylindrical shape.

The oil pump 30 has an input shaft 31 to which the rotation of the output shaft 2 is transmitted by being linked to the output shaft 2 of the electric motor 1 via a motive power transmission mechanism 50. The input shaft 31 is inserted through the hollow portion in the output shaft 2 and supported so as to be rotatable relative to the output shaft 2 via two bushes 61 and 62. As described above, the output shaft 2 and the input shaft 31 are arranged coaxially.

The motive power transmission mechanism 50 selectively rotates the input shaft 31 of the oil pump 30 by the motive power from the electric motor 1 or the engine. The motive power transmission mechanism 50 has an external gear 51 that is integrally formed on the tip portion of the output shaft 2 of the electric motor 1, a ring-shaped internal gear 52 that surrounds the external gear 51 and that is rotated by the motive power from the engine, a plurality of planet gears 53 that are arranged between and meshed with the external gear 51 and the internal gear 52 so as to be able to revolve between the external gear 51 and the internal gear 52 and to rotate about rotation shafts 55, and a carrier 54 that is linked to the plurality of the planet gears 53 via the rotation shafts 55 and linked to the input shaft 31.

At the time when the engine is driven, the internal gear 52 linked to the engine via a chain is rotated, whereas the electric motor 1 is in the non-driven state, and the external gear 51 that is integral with the output shaft 2 is not rotated. As the internal gear 52 is rotated, the planet gears 53 are revolved, and the input shaft 31 that is linked with the planet gears 53 via the carrier 54 is rotated. As described above, at the time when the engine is driven, the electric motor 1 is in the non-driven state, and the oil pump 30 is driven by the motive power from the engine.

In order to prevent the rotation of the engine from being transmitted to the external gear 51 and to prevent the electric motor 1 from being rotated, a one-way clutch 56 that restricts the rotation of the output shaft 2 that is integral with the external gear 51 is provided between the output shaft 2 and a pump cover 32 of the oil pump 30. The one-way clutch 56 allows the rotation of the output shaft 2 only in one direction, allows the rotation of the output shaft 2 when the electric motor 1 is driven, and restricts the rotation of the output shaft 2 when the input shaft 31 is rotated by the motive power from the engine.

At the time when the engine is not driven, the electric motor 1 is driven to rotate the external gear 51 that is integral with the output shaft 2, whereas the internal gear 52 linked with the engine via the chain is not rotated. As the external gear 51 is rotated, the planet gears 53 are revolved, and the input shaft 31 linked to the planet gears 53 via the carrier 54 is rotated. As described above, at the time when the engine is not driven, the oil pump 30 is driven by the motive power from the electric motor 1.

The electric motor 1 is accommodated in the interior of a motor housing 5. The one-end-side opening portion of the motor housing 5 is closed off by the pump cover 32 of the oil pump 30. The motor housing 5 and the pump cover 32 are fastened by a bolt 6.

The electric motor 1 includes a motor rotor 3 that has a plurality of permanent magnets arranged in a circumferential direction and that is fixed to the output shaft 2 and a stator 4 that has a coil and that is fixed to the inner circumference of the motor housing 5. The motor rotor 3 and the stator 4 are arranged concentrically such that a small gap is present between them.

One end side of the output shaft 2 is rotatably supported with the pump cover 32 through a first bearing 7. The other end side of the output shaft 2 is inserted through the motor housing 5, formed as the external gear 51, and linked to the input shaft 31 via the motive power transmission mechanism 50. The middle portion of the output shaft 2 is rotatably supported with the motor housing 5 through a second bearing 8.

At the outer circumference of the motor housing 5, the internal gear 52 is rotatably supported through a third bearing 9. The internal gear 52 has a structure that also serves as the casing of the motive power transmission mechanism 50.

The oil pump 30 is a vane pump that includes a pump rotor 33 that is linked to the input shaft 31, a plurality of vanes 34 that are provided so as to be movable in a reciprocating manner in the radial direction with respect to the rotor 33, and a cam ring 35 that accommodates the rotor 33 such that the end portions of the vanes 34 are in contact with the inner circumferential surface of the cam ring 35 and slidably move together with the rotation of the rotor 33.

In the cam ring 35, a plurality of pump chambers are defined by the outer circumferential surface of the rotor 33, the inner circumferential surface of the cam ring 35, and the adjacent vanes 34.

The cam ring 35 is a ring-shaped member whose inner circumferential surface has a substantially elliptical shape and has two suction regions at which the displacements of the pump chambers are extended and two discharge regions at which the displacements of the pump chambers are contracted.

A first side plate 36 is arranged at side surfaces of the rotor 33 and the cam ring 35, at one side, so as to be in contact therewith, and a second side plate 37 is arranged at side surfaces of the rotor 33 and the cam ring 35, at the other side, so as to be in contact therewith. As described above, the first side plate 36 and the second side plate 37 are arranged so as to flank the side surfaces of the rotor 33 and the cam ring 35 from both sides to seal the pump chambers.

On the surface of the first side plate 36 on which the rotor 33 slidably moves, two groove-shaped suction ports (not shown) having the arc shape that open correspondingly to the suction regions of the cam ring 35 and that guide the working oil to the pump chambers are formed.

On the second side plate 37, two arc-shaped discharging ports 39 that open correspondingly to the discharge regions of the cam ring 35 and that guide the working oil discharged from the pump chambers to a high-pressure chamber 38 are formed in a penetrated manner.

The respective pump chambers in the cam ring 35 suck the working oil from a suction channel 40 through the suction ports at the suction regions of the cam ring 35 and discharge the working oil to the high-pressure chamber 38 through the discharging ports at the discharge regions of the cam ring 35 together with the rotation of the rotor 33. As described above, the respective pump chambers in the cam ring 35 supply and discharge the working oil by the extensions and contractions with the rotation of the rotor 33. The working oil discharged to the high-pressure chamber 38 is supplied to hydraulic equipment.

The each of the members including the rotor 33, the cam ring 35, the first side plate 36, and the second side plate 37 is accommodated in the interior of a pump body 41. The one-end-side opening portion of the pump body 41 is closed off by the pump cover 32. The pump cover 32 is arranged so as to be interposed between the motor housing 5 and the pump body 41 and to close off the opening portions of the motor housing 5 and the pump body 41.

A through hole 43, through which the input shaft 31 is inserted, is formed in the pump cover 32. The through hole 43 is formed from a large-inner-diameter portion 43*a*, in which the one-way clutch 56 is provided, a medium-inner-diameter portion 43*b*, in which the bearing 7 is provided, that has smaller diameter relative to the large-inner-diameter portion 43*a*, and a small-inner-diameter portion 43*c* that has smaller diameter relative to the medium-inner-diameter portion 43*b*.

A suction opening 40*a* of the suction channel 40 is formed so as to open at the external surface of the pump body 41. The electric oil pump 100 is arranged such that the output shaft 2 and the input shaft 31 are disposed in the direction substantially parallel to the surface of the working oil stored in a tank (not shown) and such that the suction opening 40*a* of the suction channel 40 is submerged in the working oil in the tank. As described above, the electric oil pump 100 is arranged such that a part or whole thereof is submerged in the working oil in the tank.

Here, in the oil pump 30, the side surfaces of the rotor 33 and the cam ring 35, at both sides, are flanked by the first side plate 36 and the second side plate 37, thereby sealing the pump chambers. However, it is not possible to completely prevent the working oil in the pump chambers from being leaked along the side surfaces of the rotor 33 and the cam ring 35, at both sides. As described above, with the oil pump 30, it is not possible to completely prevent occurrence of leakage of a drain oil from the inside, in other words, occurrence of leakage of the drain oil from the pressurized pump chambers. The oil pump 30 has an introducing channel 70 that guides the drain oil that has leaked from the inside in this manner to the interior of the electric motor 1.

The introducing channel 70 is a channel that guides the drain oil to the interior of the electric motor 1 along the outer circumference of the input shaft 31. The introducing channel 70 includes a first channel 70*a* that is formed between the inner circumference of the first side plate 36 and the outer circumference of the input shaft 31 and a second channel 70*b* that is formed between the inner circumference of the pump cover 32 and the outer circumference of the input shaft 31. Specifically, the first channel 70*a* is formed at the inner circumference of the first side plate 36 so as to penetrate through in the axial direction of the input shaft 31. In addition, the second channel 70*b* is formed at the inner circumference of the small-inner-diameter portion 43*c* of the pump cover 32 so as to penetrate through in the axial direction of the input shaft 31. The first channel 70*a* and the second channel 70*b* are formed as ring-shaped channels so as to extend along the entire portion of the outer circumference of the input shaft 31. The first channel 70*a* and the second channel 70*b* may also be formed so as to extend along a part of the outer circumference of the input shaft 31. In other words, the first channel 70*a* and the second channel 70*b* may be formed as grooves in the inner circumference of the first side plate 36 and the inner circumference of the small-inner-diameter portion 43*c* of the pump cover 32, respectively.

The first channel 70*a* is formed such that its end part faces the side surfaces of the rotor 33 and the cam ring 35, and the drain oil that has leaked from the pump chambers in the oil pump 30 flows thereinto. In addition, the second channel 70*b* is formed such that its end part faces the end part of the output shaft 2, and the drain oil that has leaked from the pump chambers is guided to a gap between the output shaft 2 and the input shaft 31 and to the bearing 7. The drain oil that has been guided to the bearing 7 flows into the interior of the electric motor 1 through the one-way clutch 56. As described above, the drain oil that has leaked from the pump chambers in the oil pump 30 is guided to the interior of the electric motor 1 and to the gap between the output shaft 2 and the input shaft 31 through the introducing channel 70 formed along the outer circumference of the input shaft 31.

The electric motor 1 has a discharging channel 71 that discharges the drain oil that has been guided into the interior thereof to the tank. The discharging channel 71 is formed as a ring-shaped channel between the outer circumference of the output shaft 2 and the inner circumference of the motor housing 5. Alternatively, the discharging channel 71 may be formed as a groove in the inner circumference of the motor housing 5.

The drain oil that has flowed into the interior of the electric motor 1 is discharged to the outside of the electric motor 1 from the discharging channel 71 through a gap between the rotor 3 and the stator 4 and through the bearing 8. The drain oil that has passed the discharging channel 71 is discharged to the tank through the motive power transmission mechanism 50.

In addition, the drain oil that has been guided to the gap between the output shaft 2 and the input shaft 31 through the introducing channel 70 is discharged to the tank from the motive power transmission mechanism 50 through two bushes, namely, a first bush 61 and a second bush 62, interposed between the outer circumference of the input shaft 31 and the inner circumference of the output shaft 2.

According to the embodiment described above, the effects and advantages shown below can be afforded.

Because the drain oil that has leaked from the interior of the oil pump 30 is pressurized to some extent, the drain oil is guided to the interior of the electric motor 1 through the introducing channel 70 of the oil pump 30 and discharged to the tank through the discharging channel 71 of the electric motor 1. As described above, the drain oil flows in one direction from the oil pump 30 to the tank through the interior of the electric motor 1; and therefore, it is possible to prevent the oil that may contain contaminants at outside the electric oil pump 100 from entering the interior of the electric motor 1. Therefore, an oilproof structure is not required for the electric motor 1, and it is possible to omit an oil seal or an O-ring and to obtain the electric oil pump 100 with low-cost.

In addition, the drain oil that has leaked from the interior of the oil pump 30 is supplied continuously to the bearing 7, the one-way clutch 56, the bearing 8, and the bushes 61 and 62, which require lubrication.

In addition, because the electric oil pump 100 is configured such that the drain oil that has leaked from the interior of the oil pump 30 passes the interior of the electric motor 1 through the introducing channel 70 and the discharging channel 71, it is possible to cool the interior of the electric motor 1 directly with the drain oil. Therefore, a special structure for dissipating the heat need not be provided on the electric motor 1.

Furthermore, because the electric oil pump 100 is structured such that the output shaft 2 of the electric motor 1 has a hollow structure and the input shaft 31 of the oil pump 30 is inserted through the output shaft 2, it is possible to reduce the number of bearings, simplify the structure, and reduce the size thereof.

Embodiments of this invention were described above, but the above embodiments are merely examples of applications of this invention, and the technical scope of this invention is not limited to the specific constitutions of the above embodiments.

For example, the first side plate 36 may be omitted, and the pump cover 32 may be arranged so as to be in contact with the side surfaces of the rotor 33 and the cam ring 35, at one side. In this case, the introducing channel 70 is formed from the second channel 70*b* only.

In addition, in the above-mentioned embodiment, although a description has been given of a case where the oil pump 30 is a vane pump, the oil pump 30 may be a gear pump and a piston pump.

This application claims priority based on Japanese Patent Application No. 2011-287893 filed with the Japan Patent Office on Dec. 28, 2011, the entire contents of which are incorporated into this specification.

INDUSTRIAL APPLICABILITY

The electric oil pump according to this invention can be used as a hydraulic supply source that supplies the working oil to a continuously variable transmission for a vehicle etc.

The invention claimed is:

1. An electric oil pump, comprising:
an electric motor; and
an oil pump that is driven by a motive power from the electric motor, wherein
the oil pump has an introducing channel that guides a drain oil that has leaked from an interior of the oil pump to an interior of the electric motor;
the electric motor has
a discharging channel that discharges the drain oil that has been guided to the interior of the electric motor to a tank; and
a hollow output shaft;
the oil pump has an input shaft that is inserted through the output shaft and linked to the output shaft via a motive power transmission mechanism; and
the drain oil leaked from the interior of the oil pump is guided to the interior of the electric motor and to a gap between the output shaft and the input shaft through the introducing channel that is formed along an outer circumference of the input shaft.

2. An electric oil pump according to claim 1, wherein
the motive power transmission mechanism has:
an external gear that is integral with the output shaft;
a ring-shaped internal gear that surrounds the external gear and is rotated by a motive power from an engine;
a plurality of planet gears that are arranged between and meshed with the external gear and the internal gear; and
a carrier that is linked to the planet gears and linked to the input shaft; and
the input shaft is selectively rotated by the motive power from the electric motor or the engine.

3. An electric oil pump according to claim 2, further comprising
a one-way clutch that restricts the rotation of the output shaft when the input shaft is rotated by the motive power from the engine.

4. An electric oil pump according to claim 1, further comprising a bush interposed between the outer circumference of the input shaft and an inner circumference of the output shaft.

5. An electric oil pump according to claim 1, wherein
the oil pump includes a pump body having an opening and a pump cover configured to close the opening, and
the introducing channel comprises a channel between an inner circumference of the pump cover and the outer circumference of the input shaft.

6. An electric oil pump according to claim 1, wherein the oil pump includes a high-pressure chamber from which the drain oil leaks.

7. A hydraulic supply source for a vehicle, comprising the electric oil pump according to claim 1.

* * * * *